United States Patent [19]

Dietrich

[11] 4,409,803

[45] Oct. 18, 1983

[54] APPARATUS FOR THE PARTING OF HIDE HAIR

[75] Inventor: Herbert Dietrich, Kaiserslautern, Fed. Rep. of Germany

[73] Assignee: Pfaff Industriemaschinen GmbH, Fed. Rep. of Germany

[21] Appl. No.: 364,892

[22] Filed: Apr. 2, 1982

[30] Foreign Application Priority Data

Apr. 6, 1981 [DE] Fed. Rep. of Germany ..... 3113834

[51] Int. Cl.[3] ..... C14B 15/00

[52] U.S. Cl. ..... 69/27

[58] Field of Search ..... 69/27

[56] References Cited

U.S. PATENT DOCUMENTS 2,961,733 11/1960 Hart ..... 69/27

3,557,413 1/1971 Kloeckener ..... 69/27

*Primary Examiner*—Patrick D. Lawson

*Attorney, Agent, or Firm*—McGlew and Tuttle

[57] ABSTRACT

An apparatus for the parting of hide hair is provided with a hide hair divider moved reciprocally in a longitudinal direction and comprising a plurality of wedge-shaped parting points and similarly formed counter-points. Between the parting and counter-points which are directed against each other, a comparatively narrow gap is provided, which widens to a wide opening. Because of the narrow gap, the parting and counter points cover each other in their path of motion, whereby the danger of the hide hair divider becoming hooked at the hide is reduced.

9 Claims, 3 Drawing Figures

APPARATUS FOR THE PARTING OF HIDE HAIR

FIELD AND BACKGROUND OF THE INVENTION

The present invention relates in general to hide processing equipment and in particular to a new and useful apparatus for parting the hairs of a hide to form a furrow for the facilitation of cutting and sewing the hide.

An apparatus for the parting of the hair of artificial or animal hides can be seen from German Pat. No. 22 04 399. The parting device is provided in equipment for the letting out of the hides. The parting device consists of a needle-like point which is disposed at the front end of a parting sword which is displaceable parallel to the hide. The parting sword is moved into the parting furrow created by the needle-like point to hold the hide hair in the parting position during the following operations.

A parting device formed by a needle-like point does not give satisfactory results in the case of very thick hides and in particular hides with thick underwool. In fact, because the needle-like point must be provided with a slight rounding or bend, because of the danger of it getting hooked in the leather, it may happen that the needle-like point only bends over some of the hairs, which in thick hides are usually thin, and then slides over them without parting them. If hairs remain in the parting furrow however, after a parting operation, this will have the result that during the subsequent cutting of the hide these hairs get through the commissure or junction, to the smooth (hairless) side of the hide and are fixed in this position when the hide parts are then sewn together. These hairs are then missing on the hairy side of the hide, which may result in an unattractive appearance.

A similar problem exists for the sewing on of hides or plush materials. Here the seam is to be placed in a hair-free parting furrow, so that on the one hand the seam will be covered by the hairs spring back from the furrow and on the other hand again the appearance of the hair nap will remain undisturbed to the full extent possible.

SUMMARY OF THE INVENTION

It is the object of the present invention to provide an apparatus for the parting of hide hair which is able to form a hair free parting furrow even on thick hides.

Accordingly an object of the present invention is to provide an apparatus for the parting of hide hairs which comprises a hide hair divider extending in a plane normal to the hide, a drive mechanism for moving the divider in relative parallel motion with respect to the hide, the hide hair divider comprising a plurality of spaced webs each terminating in a wedge shaped or cuneiform parting point, and an oppositely directed counter point, there being formed a limiting edge between the point and counter point with points and counter points of adjacent webs respectively forming relatively narrow gaps therebetween.

During the relative movement of the hide divider and the hide, several parting points thus become active successively on the hide which are additive in their parting action. Since the parting points are separated by only a narrow gap and are thus arranged directly behind the rear sections of the webs, the parting points are largely covered by the webs, so that the danger of the parting points becoming hooked in the leather of the hide is greatly reduced. This danger is reduced also by the additional fact that the outer edge of the webs or parting points that are turned toward the hide, extend substantially parallel to the hide and thus lie in its entire length on the hide or respectively in the parting furrow formed by the parting points.

The parting action is intensified still more by driving the hide divider in a swinging motion at least at the beginning of the parting process, which is parallel to the hide, and designing the rear sections of the webs as counter-points corresponding to the parting points but oriented in the opposite direction. After only a few swinging strokes, the parting and counter points in engagement with the hide will have formed a largely hair-free parting furrow. Should a few hairs remain in the parting furrow, they are forced out of it during the lengthwide movement of the hide divider occurring subsequently or simultaneously. By the further measure of letting the gap between the webs terminate in a relatively wide opening, penetration of the hide divider into thick hides is facilitated, in that in some of the hairs lying in the region of the part only the hair root is expelled laterally out of the parting furrow, while the middle portion of these hairs and the hair tips project into the wide openings.

If the hides rest on a support, hair-side down, and hence the hide divider comes into engagement with the hide from the underside through a slot in the support, it is possible, according to another feature of the invention, to achieve the advantage that before parting, the hide divider is moved so far below the hide to be parted or, in the case of several hides to be parted simultaneously, so far below these hides that thereafter the hide divider on being lifted into the parting position extends over the entire width of the hide or hides. In this manner the hide or hides is/are stabilized in the slot region of the support carrying them and any previously hanging hide edges are raised, so that during the subsequent parting operation each hide will, from the start, extend parallel to the hide divider in the region of the parting furrow.

Another object of the invention is to provide such an apparatus wherein the drive mechanism executes reciprocal motion of the hide hair divider, each gap expanding in the hide hair divider into a wide, preferably circular opening, to facilitate the removal of hide hair from a furrowed area.

A further object of the invention is to provide such an apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
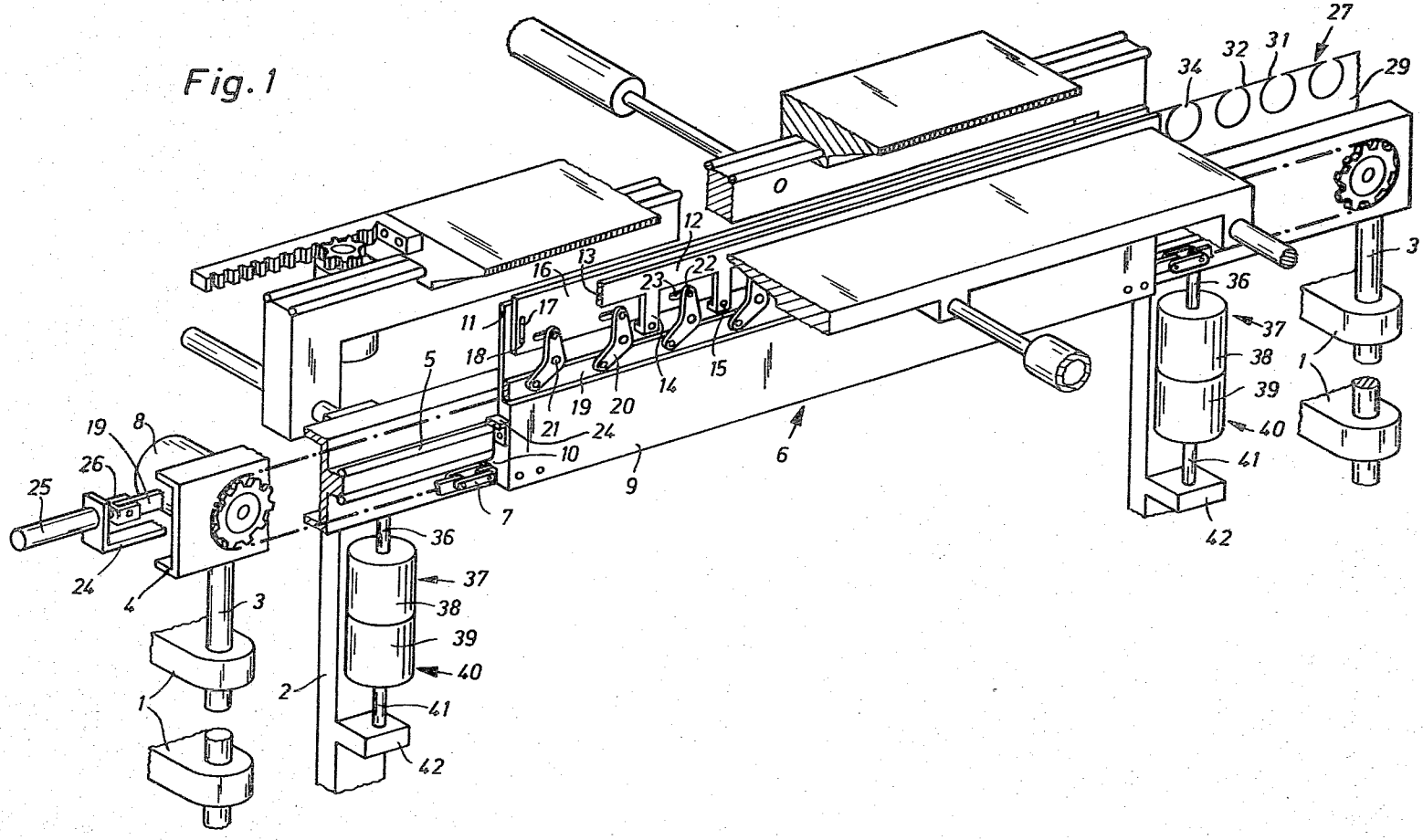
FIG. 1 is a diagrammatic perspective representation of a parting sword with attached hide divider.

Referring to the drawings in particular, the invention embodied therein, in FIG. 1, comprises a parting sword 6 which includes a divider 27 for parting the hairs of a hide to form a furrow which is clear of hair. This furrow facilitates the subsequent cutting and sewing of the hide.

The apparatus includes a beam 4 which is carried by a pair of guide rods 3 that are slidably mounted for vertical movement in shoulders 1 that affix to a frame 2 of a hide feeding or letting-out machine. Beam 4 includes a guide bar 5 which slidably receives the parting sword 6 for horizontal movement thereon. Parting sword 6 is connected to a chain 7 that is wrapped on a pair of sprockets that are rotated by a motor 8 mounted on beam 4. Motor 8 is reversible and can thus slide the parting sword 6 in reciprocal horizontal motion.

The parting sword 6 includes a slide 9 which is mounted by shoulders 10 on the guide bar 5. A sideplate 11 is fastened on slide 9. Another sideplate 12 consists of a continuous horizontal stringer 13 and several downwardly extending webs 14. By screws 15 passed through the lower ends of the webs 14, the sideplate 12 is fastened to the sideplate 11 at a regular spacing therefrom. In the gap between the sideplates 11, 12 a vertically movable interplate 16 is arranged. At the ends of the interplate 16, vertical oblong slots 17 are provided, into each of which a pin 18, fastened on the sideplate 11, extends.

Between the side plates 11 and 12, below the interplate 16, a pull rod 19 is disposed, resting on slide 9 and displaceable in the longitudinal direction. Several angle levers 20 are articulated on the pull rod 19, which are arranged between the webs 14 and mounted on pins 21 fixed on the sideplate 11. Each of the upper ends of the angle levers 20 carries a pin 22. Each pin 22 protrudes into one of several horizontal oblong slots 23 provided in the interplate 16. A bracket 24 (shown broken for clarity) is secured on slide 9, which carries a compressed air cylinder 25. The piston rod of the compressed asir cylinder 25 is connected with the pull rod 19 by a forked head 26.

Figure 2:
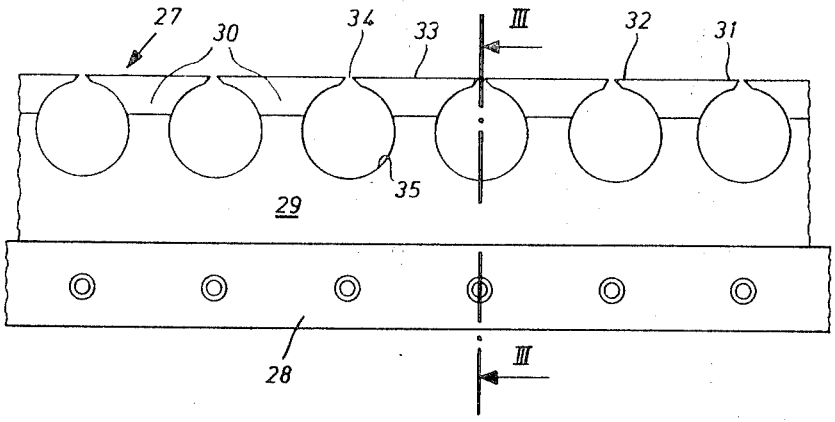
FIG. 2 is a partial view of the hide divider.

On the end face of the parting sword 6, away from the compressed air cylinder 25, a hide divider 27 is arranged. The hide divider 27 consists of a carrier 28 fastened to the side plates 11 and 12 and an elongated plate 29 screwed to the carrier and lying in a vertical plane aligned with the interplate 16. In the upper zone of plate 29 several webs 30 are formed (FIG. 2), which terminate in pairs of cuneiform or wedge shaped tips pointing in opposite directions. The tips pointing to the right according to FIGS. 1 and 2, form parting points 31, and the tips pointing to the left are counter-points or rear sections 32. The upper limiting edges 33 of the parting points 31 and counter-points 32 are parallel to the upper edges of the sideplates 11 and 12 and lie, by these upper edges, in a common horizontal plane. Between the parting point 31 of one web 30 and counter-point 32 of an adjacent web 30, a narrow gap 34 exists. Each gap 34 widens to a relatively wide circular opening 35.

The beam 4 is supported on the piston rod 36 of two compressed air cylinder 37. The housing 38 of each compressed air cylinder 37 is secured on the housing 39 of an additional serially connected compressed air cylinder 40, whose piston rod 41 takes support on a shoulder 42 secured to frame 2. With the two pairs of serially connected compressed air cylinders 37, 40 the beam 4 can be moved into three different height positions.

Figure 3:
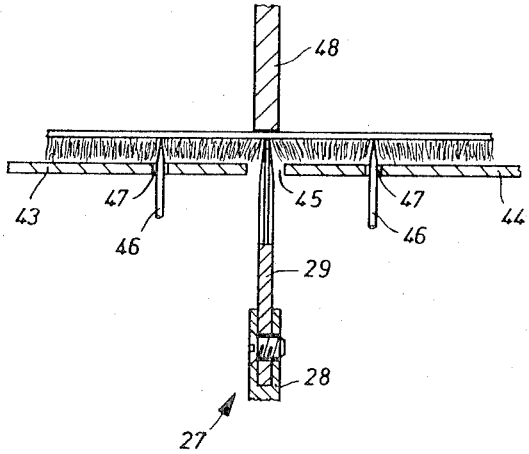
FIG. 3 is a sectional view of the hide divider taken along the line III—III of FIG. 2.

According to FIG. 3, two table panels 43, 44 are fastened on frame 2. Between the table panels 43, 44 a slot 45 is formed, which extends parallel to the parting sword 6 and hide divider 27. A needle row 46, lying in the vicinity of slot 45, is associated with each table panel 43, 44. The needle rows are movable up and down in a manner not explained in detail, and project in the raised position through openings 47 in the table panels 43, 44 beyond the upper side thereof. Above slot 45, a hold-down 48 which is movable up and down in a manner not explained in detail is arranged, which is as long as slot 45. See the inventor's copending application entitled Feed Device Equipment For Letting Out Hides for additional details. The apparatus of the invention operates as follows:

A hide to be let out is placed in the table panels 43, 44 with the fur side down as shown in FIG. 3. Then the needle rows 46 are moved upwardly, whereby the hide is fixed on the table panels 43, 44. Thereafter, the hold-down 48 is lowered onto the hide as shown.

At this point the parting sword 6, which is present in its lowered position, us run by the brake motor 8 from an inactive position laterally of the table panels 43, 44 to below the panels 43, 44 far enough for the front section of the hide divider 27 to come under the hide. Thereupon the two compressed air cylinders 37 are pressurized, whereby the beam 4 with the parting sword 6 and the hide divider 27 is lifted. At the end of this lifting movement, the hide divider 27 applies against the hide by the limiting edges 33 of the parting points and counterpoints 31, 32.

At the start of the then following parting process, the brake motor 8 is operated several times briefly in different directions of rotation, whereby the hide divider 27 is set in swinging motion in the lengthwise direction. Due to this swinging motion, a parting action is executed alternately by the parting points 31 in one direction and by the counter-points 32 in the other direction. The hairs lying in the immediate parting zone are then pushed aside by the parting and counter points 31, 32, whereby a furrow is formed in the nap. Since the gaps 34 widen to wide openings 33, in some of the hairs present in the parting zone only the hair roots are pushed aside, while the middle portion of these hairs and the hair tips protrude into the openings 35. In this manner the hide divider 27 can penetrate more easily into thick hides.

After completion of a selectable number of swinging strokes, the parting sword 6 and the hide divider 27 are moved by the brake motor 8 continuously in lengthwise direction. Any hairs left in the parting furrow are thereby pushed out of the parting furrow due to the additive action of the parting points 31 now passing evenly through the furrow. In the further course of this longitudinal movement, the parting sword 6, with the interplate 16 lowered, us pushed into the now hair-free parting furrow. During the subsequent operations of the letting out of hide, namely the cutting of the hide and the later sewing together of the hide parts, the parting sword 6 keeps the hairs that had been pushed aside out of the furrow, so that in cutting the hide hairs are cut off with the hide and after the sewing together operation, no hairs will protrude through the seam to the smooth side of the hide.

As the gaps 34 are very narrow, the parting points and counter points 31, 32 cover each other, so that the danger of the points 31, 32 becoming hooked in the leather or at the edge of the hide is greatly reduced. This danger is reduced also by the additional fact that the upper limiting edges 33 of the parting and counter points 31, 32 turned toward the hide extend parallel to the hide.

The length of the hide divider 27 is taken so that in parting it extends over the total width of the hide to be parted or, in the case of several hides to be parted simultaneously, over the total width of these hides. In this way the hides are supported in the region of the slot 45, so that the hide edges cannot sag.

While a specific embodiment of the invention has been shown and described in detail to illustrate the application of the principles of the invention, it will be understood that the invention may be embodied otherwise without departing from such principles.

What is claimed is:

1. A device for parting hair on a hide to form a furrow comprising:

a hide hair divider adapted to extend in a plane normal to a hide;

drive means connected to said divider for moving said divider in a direction parallel to the plane and across a hide;

said divider formed of a plurality of webs each having an upstream terminating wedge-shaped point and a downstream section in said direction, each web having a limiting edge between each upstream point and downstream section extending substantially parallel to said direction, an upstream point of each web forming a gap with a downstream section of each adjacent web.

2. A device according to claim 1, wherein each downstream section comprises a wedge-shaped counter point, said drive means adapted for moving said divider in reciprocating motion along said direction.

3. A device according to claim 1, wherein said hide hair divider has a length at least as great as the width of a hide on which the furrow is to be formed.

4. A device according to claim 2, including a relatively wide opening between each adjacent web bounded by each respective gap.

5. A device according to claim 4, wherein said opening is substantially circular.

6. A device according to claim 4, wherein said drive means includes a parting sword, a pair of spaced plates extending upwardly of said parting sword, a drive mechanism connected to said drive sword for moving said drive sword in said direction, said divider web edges lying in a common plane with top edges of said pair of spaced plates, and an intermediate plate movably mounted to said parting sword between said pair of spaced plates and in said plane of said divider.

7. An apparatus for the parting of hide hair, including a hide hair divider extending in a plane normal to the hide and a drive mechanism for the execution of a relative movement parallel to the hide between the hide hair divider and the hide, characterized in that the hide hair divider comprises several webs, each terminating in a cuneiform parting point on one side and a rear section on the other and with at least one limiting edge extending substantially parallel to the hide and between each parting point and rear section, and that a comparatively narrow gap exists between the parting points and the rear sections of adjacent webs.

8. An apparatus according to claim 7, characterized in that the relative movement of the hide divider is at least at the start of a parting process a swinging motion, each gap widening to a relatively wide opening, and the rear sections of the webs being formed as counter-points corresponding to the parting points.

9. An apparatus according to claim 7, characterized in that the hide divider extends at least over the total width of the hides to be parted simultaneously.

* * * * *